US006774577B2

(12) United States Patent
Choi

(10) Patent No.: US 6,774,577 B2
(45) Date of Patent: Aug. 10, 2004

(54) FLAT PANEL DISPLAY DEVICE FOR COMPENSATING THRESHOLD VOLTAGE OF PANEL

(75) Inventor: Jeung-Hie Choi, Ichon-shi (KR)

(73) Assignee: Hynix Semiconductor Inc., Kyoungku-do (KR)

( * ) Notice: Subject to any disclaimer, the term of this patent is extended or adjusted under 35 U.S.C. 154(b) by 0 days.

(21) Appl. No.: 10/318,070

(22) Filed: Dec. 13, 2002

(65) Prior Publication Data

US 2004/0017161 A1 Jan. 29, 2004

(30) Foreign Application Priority Data

Jul. 24, 2002 (KR) ..... 10-2002-0043573

(51) Int. Cl.[7] ..... G09G 3/10
(52) U.S. Cl. ..... 315/169.3; 345/76; 345/211

(58) Field of Search ..... 315/169.1, 169.3; 345/211, 212, 76, 77, 78, 80

(56) References Cited

U.S. PATENT DOCUMENTS 6,232,946 B1 * 5/2001 Brownlow et al. ..... 345/98
6,380,913 B1 * 4/2002 Hush et al. ..... 345/75.2
2002/0089357 A1 * 7/2002 Pae et al. ..... 327/112

* cited by examiner

*Primary Examiner*—Don Wong
*Assistant Examiner*—Thuy Vinh Tran
(74) *Attorney, Agent, or Firm*—Birch, Stewart, Kolasch & Birch, LLP

(57) ABSTRACT

The present invention relates to a flat display panel device for compensating a threshold voltage of a panel. Because of an ability of compensating the panel threshold voltage, it is possible to simplify a circuit and a driving method, enhance particularly an image quality of a display unit and increase an opening ration of the panel.

7 Claims, 5 Drawing Sheets

FLAT PANEL DISPLAY DEVICE FOR COMPENSATING THRESHOLD VOLTAGE OF PANEL

FIELD OF THE INVENTION

The present invention relates to a flat panel display device for compensating a threshold voltage of a panel; and, more particularly, to a flat panel display device capable of simplifying a circuit and a driving method, improving an opening ratio of a panel and enhancing an image quality of a display unit by compensating a panel threshold voltage through a driving circuit of the flat panel display device.

DESCRIPTION OF RELATED ARTS

Generally, electroluminescence (hereinafter referred as to EL) is a phenomenon that a fluorescent substance luminesces as a current passes through it. An EL panel is typically used for illuminating light at the back of a liquid crystal display (hereinafter referred as to LCD) of a portable computer such as a notebook computer. However, since the EL panel is recently enabled with a function of self-luminescence, an additional backlight is not required compared to a conventional LCD. Based on this advantage and studies on such methods for acquiring a high definition image and a longer lifetime of the EL, the EL panel, in today, is employed for a high definition display unit including a LCD for a mobile telecommunication terminal. Furthermore, the EL panel will have broad applications in a near future. The EL panel includes an organic or inorganic self-luminescent body being placed in between two thin electrodes. Indeed, one of the two thin electrodes is transparent. This luminescence is caused by the energy released when excited electrons of a particular impurity at a central luminescence of a luminescent substance return to their ground states. Herein, free electrons accelerated by the EL excite the electrons of the particular impurity, which is also called an activator. Intensity of the luminescence increases in proportion to $\exp(-c/\sqrt{v})$, and frequency also increases proportionally up to a certain point.

The luminescence phenomenon due to an organic substance is discovered by Anthracene in 1960s. Thereafter, Eastman Kodak Company developed an ultra thin film double layer stacking type organic EL device in 1987, and Pioneer Corporation commercialized a single color organic EL display device by the end of 1997. A 5.5 inched natural color organic EL display device developed by Sanyo-Kodak is further demonstrated at the Society for Information Display(SID) in 2000.

The organic EL device has about 10 V of a driving voltage, which is lower than driving voltages of other display devices such as a thin film transistor-liquid crystal display (TFT-LCD), a plasma display panel (PDP), a field emission display (FED) and so forth. Also, the organic EL device has an advanced perceptibility due to self-luminescence. Furthermore, it is possible to make a thickness of the organic EL device thinner because it does not need a backlight unlike the TFT-LCD. Compared to currently used LCD, the organic EL device also has a rapid responsiveness and a wide angular field, and thus, it is expected to be a next generation display device.

FIG. 1 is a circuit diagram showing an organic EL display unit according to a prior art. The conventional organic EL display unit 100 includes a first TFT 101 having a first (source) terminal that receives a data signal from a source line and a second (gate) terminal that receives a gate enable signal from a gate enable line (GE), a second TFT 102 having a first (source) terminal supplied with power from a power line and a second (gate) terminal connected to a third (drain) terminal of the first TFT 101, a power maintenance capacitor 103 that charges a driving voltage of the second TFT 102 through which a first terminal is connected to the first terminal of the second TFT 102 and a second terminal to the third terminal of the first TFT 101, and an organic EL device 104 having a first terminal connected to a third (drain) terminal of the second TFT 102 and a second terminal is coupled to a ground terminal luminesces in case that currents are flowing.

The following will describe operations of the organic EL display unit 100 in accordance with the prior art.

Firstly, a gate enable signal provided from the gate enable line (GE) is activated, and the first TFT 101 is turned on. At this time, display data are transmitted to the second terminal of the second TFT 102 through the source line and the first TFT 101. This voltage is transmitted to the second TFT 102, which is a driving transistor, and the power maintenance capacitor 103 of the power line. Once the power maintenance capacitor 103 is charged with the driving voltage, the organic EL device 104 luminesces since currents can flow from the power line to the organic EL device 104. Even if the gate enable signal from the gate enable line (GE) is inactivated, the power maintenance capacitor 103 is still able to luminesce because the driving voltage for making the organic EL device 104 luminesce is still remained causes currents to flow from the power line to the organic EL device 104.

However, in case of driving the organic EL device 104 based on the above scheme, the second TFT 102 of each display unit cell has a different threshold voltage ($V_{th}$), and thus, an amount of currents supplied to the organic EL device 104 in each cell is different. Herein, the second TFT 102 is a driving transistor for the organic EL device 104. That is, there occur problems of a non-uniform screen and a decreased image quality because intensity of luminescent light of the organic EL device 104 changes inconsistently.

FIG. 2 is a circuit diagram showing a typical organic EL display unit 200 for coping with the inconsistent $V_{th}$ according to another prior art. The typical organic EL display unit includes a first TFT 201 having a first (source) terminal that receives a data signal from a source line and a second (gate) terminal that receives a gate enable signal from a gate enable line (GE), a first capacitor 202 that charges a driving voltage of a second TFT 203 by being connected to a third (drain) terminal of the first TFT 201, the second TFT 203 having a first (source) terminal supplied with power from a power line and a second (gate) terminal connected to a second terminal of the first capacitor 202, a second capacitor 204 that charges a threshold voltage of the second TFT 203 through which a first terminal is connected to the first terminal of the second TFT 203 and a second terminal to the second terminal of the first capacitor 202, a third TET 205 having a first (source) terminal connected to the second terminal of the second TFT 203, a second (gate) terminal receiving a first switch control signal AZ and a third (drain) terminal connected to a third (drain) terminal of the second TFT 203, a fourth TFT 206 having a first (source) terminal connected to the third terminal of the third TFT 205 and a second (gate) terminal receiving a second switch control signal AZB and an organic EL device 207 that luminesces when currents are flowing through which a first terminal is connected to a third (drain) terminal of the fourth TFT 206 and a second terminal coupled to a ground terminal.

FIG. 3 is a diagram showing procedural timing for operating the organic EL display unit 200 according to still another prior art. With reference to the operational timing, the following will describe operations of the organic EL display unit 200 in accordance with the prior art.

Firstly, once a gate enable signal from the gate enable line GE is activated in a state that a second switch control signal AZB is precedently activated, the first switch control signal AZ is activated to primarily turn the second TFT 203 on, thereby charging a threshold voltage of the second TFT 203 connected to the second capacitor 204. Afterwards, the first switch control signal AZ is inactivated, and a driving voltage, i.e., DATA, of the second TFT 203 is transmitted from the source line to the first capacitor 202. Herein, the second TFT 203 is a driving transistor. Once the first capacitor 202 is charged with the driving voltage, the first capacitor 202 is supplied with the driving voltage that allows the organic EL device 207 to luminesce. At this time, the threshold voltage and the driving voltage of the second capacitor 204 drive the second TFT 203. Also, currents are set to flow from the power line to the organic EL device 207, which in turn, luminesces.

However, in the organic EL display unit 200 in accordance with the prior art, the number of periphery circuits for driving the cell also increases. Thus, an area for pure luminescence decreases, resulting in problems of decreasing an opening ratio and complicating the driving circuit since it is required to have more than 4 signal lines accompanying to an increase of control signals.

SUMMARY OF THE INVENTION

It is, therefore, an object of the present invention to provide a flat display panel device capable of simplifying a circuit and a driving method, enhancing particularly an image quality and increasing an opening ratio of a panel by compensating a panel threshold voltage when driving the flat panel display device.

In accordance with an aspect of the present invention, there is provided a flat display panel device for compensating a panel threshold voltage, including: a driving unit receiving a panel threshold voltage and outputting a driving signal, wherein the driving unit samples and charges the panel threshold voltage supplied from a source line and generates the driving signal from the panel threshold voltage charged therein when a displaying data are inputted thereto; and a displaying unit, wherein the displaying unit displays by driving a luminescent device therein with a gate enable signal from a gate enable line, a power from a power line and the driving signal from the driving unit, and supplies the panel threshold voltage to the driving unit by receiving a first switch control signal.

BRIEF DESCRIPTION OF THE DRAWING(S)

The above and other objects and features of the present invention will become apparent from the following description of the preferred embodiments given in conjunction with the accompanying drawings, in which.

DETAILED DESCRIPTION OF THE INVENTION

Figure 1:
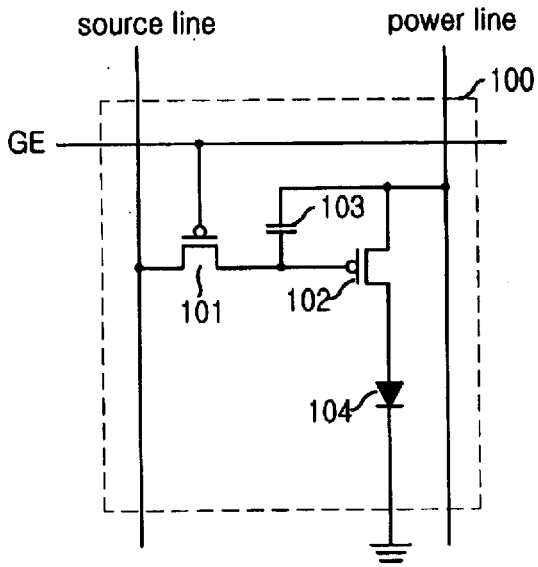
FIG. 1 (PRIOR ART)
FIG. 1 is a circuit diagram showing an organic electroluminescence (EL) display device according to a prior art.
Figure 2:
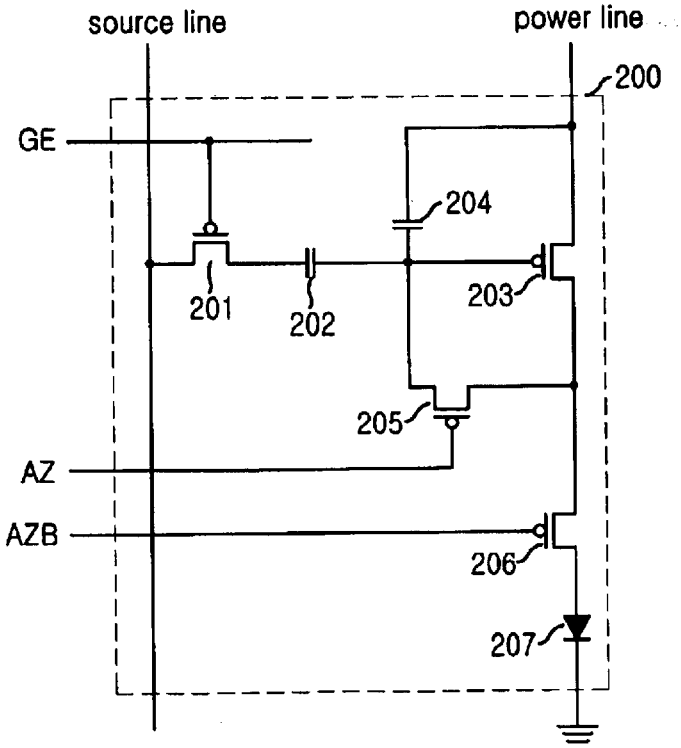
FIG. 2 (PRIOR ART)
FIG. 2 is a circuit diagram showing an organic EL display device according to another prior art.
Figure 3:
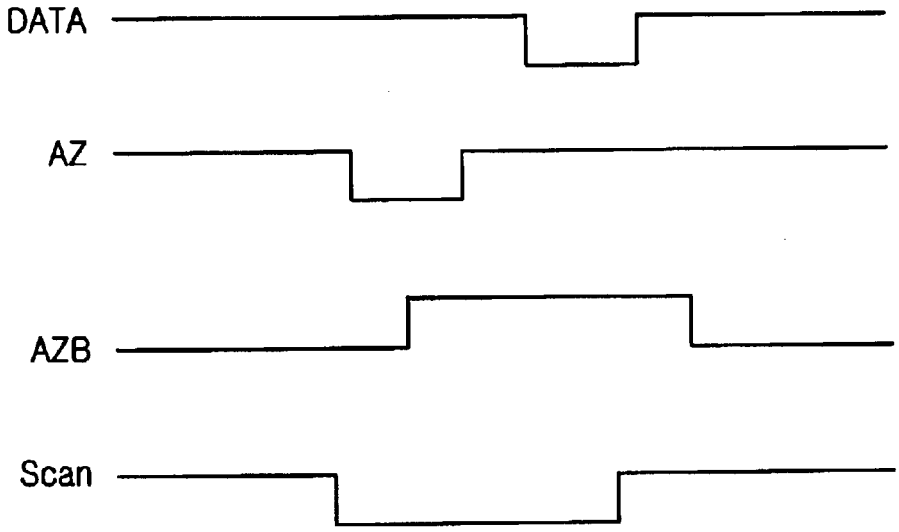
FIG. 3 (PRIOR ART)
FIG. 3 is a timing diagram showing operation of the organic EL display device according to still another prior art.
Figure 4:
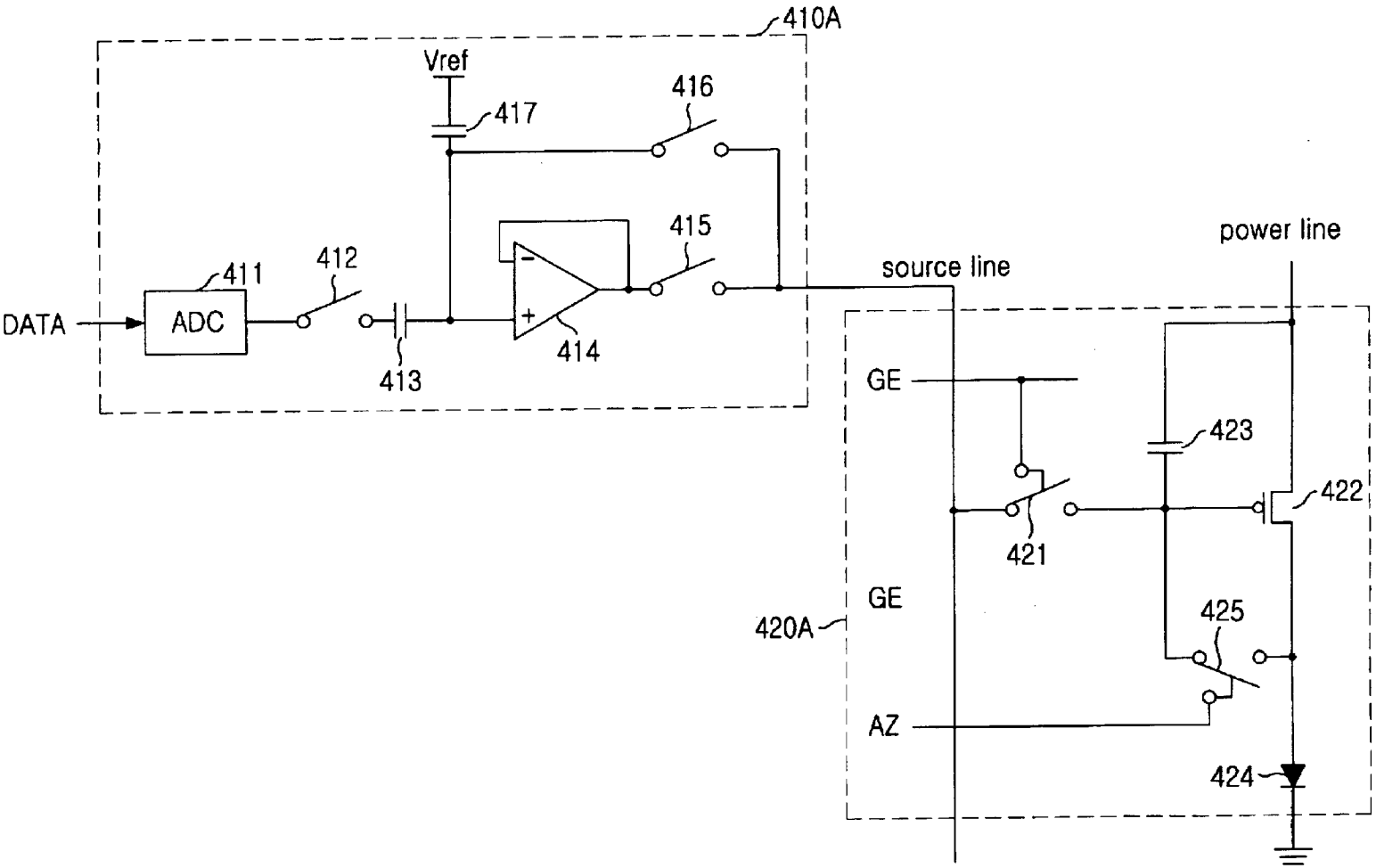
FIG. 4 is a circuit diagram showing a flat display panel device for compensating a threshold voltage of a panel in accordance with a preferred embodiment of the present invention.

FIG. 4 is a circuit diagram showing a flat display panel device for compensating a threshold voltage of a panel in accordance with a preferred embodiment of the present invention. The flat display panel device includes a driving unit 410A and a display unit 420A.

The driving unit 410A including a source line samples and charges internally a threshold voltage of a panel supplied from the source line. The driving unit 410A generates a driving signal through externally inputted data and the charged threshold voltage of the panel and outputs the driving signal through the source line. Herein, the driving unit 410A has a first analog-to-digital converter (ADC) 411, a first switch 412, a first capacitor 413, a first amplifier 414, a second switch 415, a third switch 416 and a second capacitor 417.

The first ADC 411 included in the driving unit 410A receives analog data from an external source and coverts the analog data to digital data, which is, in turn, outputted to the first switch 412.

Also, the first switch 412 included in the driving unit 410A has a first terminal connected to the first ADC 411, and performs a switching operation for passing or blocking the outputted digital data.

Meanwhile, the first capacitor 413 included in the driving unit 410A has a first terminal connected to a second terminal of the first switch 412, and functions to store electric charges after being supplied with a voltage corresponding to the digital data from the first switch 412.

In addition, the first amplifier 414 included in the driving unit 410A has a positive terminal connected to a second terminal of the first capacitor 413 and a negative terminal connected to an output terminal in a feedback. The first amplifier 414 amplifies the inputted voltage.

In the meantime, the second switch 415 included in the driving unit 410A has a first terminal connected to the output terminal of the first amplifier 414 and a second terminal connected to the source line, and performs a switching operation for passing the amplified voltage outputted from the first amplifier 414 to the display unit 420A or blocking the amplified voltage from entering to the display unit 420A. The display unit 420A will be further described in the following section.

Also, the third switch 416 included in the driving unit 410A has a first terminal connected to the source line, and performs also a switching operation for passing or blocking a panel threshold voltage sampled from the display unit 420A.

The second capacitor 417 included in the driving unit 410A has a first terminal connected to the third switch 416 and a second terminal connected to a terminal for reference voltage $V_{ref}$, and functions to store charges as being supplied with the panel threshold voltage provided from the third switch 416. Herein, the reference voltage $V_{ref}$ is a voltage for storing the panel threshold voltage in an appropriate level. A compensation voltage for a threshold value or a pre-charge of a luminescent device 424 is used as the reference voltage, since the panel luminescent device 424 of the display unit 420A has characteristics of a diode.

Furthermore, the display unit 420A includes a control signal AZ input line, a gate enable line GE, a power line and the source line connected to the driving unit 410A. The display unit 420A receives a first switch control signal AZ and supplies a panel threshold voltage to the driving unit 410A. Also, the display unit 420A performs a display operation by driving the panel luminescent device 424 through inputs of a gate enable signal from the gate enable line GE, power from the power line and a driving signal from the driving unit 410A. Herein, the display unit 420A also includes a fourth switch 421, a first thin film transistor (hereinafter referred as to TFT) 422, a third capacitor 423, the panel luminescent device 424 and a fifth switch 425.

The fourth switch 421 receives a driving signal from the source line. A switching operation of the fourth switch 421, for passing or blocking the driving signal, is controlled by a gate enable signal from the gate enable line GE. Also, the first TFT 422 included in the display unit 420A has a first (source) terminal supplied with power from the power line and a second (gate) terminal connected to a second terminal of the fourth switch 421.

The third capacitor 423 having a first terminal connected to the first terminal of the first TFT 422 and a second terminal connected to the second terminal of the fourth switch 421 functions to charge a driving voltage of the first TFT 422.

Additionally, the panel luminescent device 424 having a first terminal connected to a third (drain) terminal of the first TFT 422 and a second terminal coupled to a ground terminal luminesces when currents are flowing and displays an image that a user can perceive.

Meanwhile, the fifth switch 425 has a terminal connected to the third terminal of the first TFT 422 and a second terminal connected to the gate of the first TFT 422. A switching operation of the fifth switch, for passing or blocking the panel threshold voltage, is controlled by the first switch control signal AZ.

The following will provides detailed descriptions on procedural operations of the flat display panel device for compensating a threshold voltage of a panel in accordance with the present invention.

First of all, a gate enable signal is inputted to the fourth switch 421 included in the display unit 420A through the gate enable line GE. A first switch control signal AZ is inputted to the fifth switch 425 through the control signal AZ input line. This input of the first switch control signal AZ turns the forth switch 421 and the fifth switch 425 on so to sample a panel threshold voltage of the first TFT 422, which is a driving transistor of the panel luminescent device 424, through the source line. Then, the sampled panel threshold voltage is charged to the second capacitor 417 included in the driving unit 410A by turning on the third switch 416 included in the driving unit 410A.

The third switch 416 is then turned off, and the first switch 412 and the second switch 415 both included in the driving unit 410A are turned on to provide digital data outputted from the first ADC 411. The positive terminal of the first amplifier 414 has a voltage as the following equation.

$$V+(\text{voltage of the positive terminal})=V(\text{driving voltage for data})+V_{th}(\text{panel threshold voltage}) \quad \text{Eq. 1}$$

That is, a voltage compensating the panel threshold voltage of the first TFT 422, which is a driving transistor, is supplied as a driving voltage to the display unit 420A.

Figure 5:
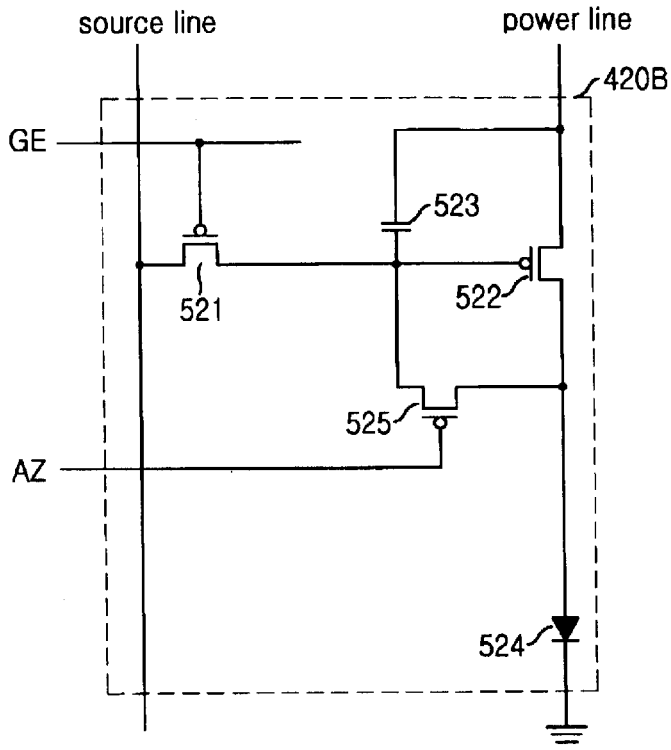
FIG. 5 is a circuit diagram showing a flat display panel device for compensating a threshold voltage of a panel in accordance with another preferred embodiment of the present invention.

FIG. 5 is a circuit diagram showing a display unit 420B included in a flat display panel device for compensating a threshold voltage of a panel in accordance with another preferred embodiment of the present invention. The display unit 420B includes a second TFT 521, a third TFT 522, a fourth 523, a panel luminescent device 524 and a fourth TFT 525.

The second TFT 521 has a first (source) terminal that receives a driving signal from a source line and a second (gate) terminal that receives a gate enable signal from a gate enable line GE, and performs a switching operation for passing or blocking the driving signal in accordance with control of the gate enable signal.

The third TFT 522 has a first (source) terminal that is supplied with power from a power line and a second (gate) terminal connected to a third (drain) terminal of the second TFT 521.

Meanwhile, the fourth capacitor 523 included in the display unit 420B having a first terminal connected to the first terminal of the third TFT 522 and a second terminal connected to the third terminal of the second TFT 521 charges a driving voltage of the third TFT 522.

The panel luminescent device 524 having a first terminal connected to a third (drain) terminal of the third TFT 522 and a second terminal coupled to a ground terminal luminesces when currents are flowing so as to display an image that a user can perceive.

The fourth TFT 525 included in the display unit 420B has a first (drain) terminal connected to the third terminal of the third TFT 522, a second (gate) terminal that receives a first switch control signal AZ from the control signal AZ input line and a third (source) terminal connected to the gate terminal of the third TFT 522. Also, the fourth TFT 525 performs a switching operation for passing or blocking the panel threshold voltage in accordance with control of the first switch control signal AZ.

Figure 6:
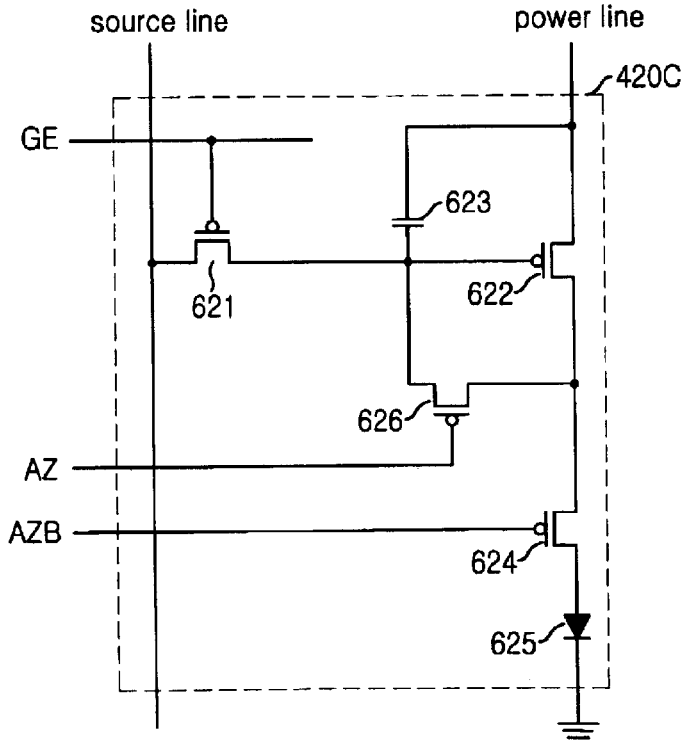
FIG. 6 is a circuit diagram showing a flat display panel device for compensating a threshold voltage of a panel in accordance with still another preferred embodiment of the present invention.

FIG. 6 is a circuit diagram showing a display unit 420C included in a flat display panel device for compensating a threshold voltage of a panel in accordance with still another preferred embodiment of the present invention. The display unit 420C includes a fifth TFT 621, a sixth TFT 622, a fifth capacitor 623, a seventh TFT 624, a panel luminescent device 625 and an eighth TFT 626.

The fifth TFT 621 included in the display unit 420C having a first (source) terminal that receives a driving signal form a source line and a second (gate) terminal that receives a gate enable signal from a gate enable signal line GE performs a switching operation for passing or blocking the driving signal in accordance with control of the gate enable signal.

The sixth TFT 622 included in the display unit 420C has a first (source) terminal provided with power from a power line and a second (gate) terminal connected to a third (drain) terminal of the fifth TFT 621.

Meanwhile, the fifth capacitor 623 included in the display unit 420C having a first terminal connected to the first terminal of the sixth TFT 622 and a second terminal connected to the third terminal of the fifth TFT 621 charges a driving voltage.

Also, the seventh TFT 624 included in the display unit 420C having a first (source) terminal connected to a third (drain) terminal of the sixth TFT 622 and a second (gate) terminal that receives a second switch control signal AZB performs a switching operation for passing or blocking the driving voltage in accordance with control of the second switch control, signal AZB.

The panel luminescent device 625 having a first terminal connected to a third (drain) terminal of the seventh TFT 624 and a second terminal coupled to a ground terminal luminesces when currents are flowing and displays an image that a user can perceive.

In the mean time, the eighth TFT 626 has a first (drain) terminal connected to the third terminal of the sixth TFT 622, a second (gate) terminal that receives a first switch control signal AZ from the control signal AZ input line and a third (source) terminal connected to the second terminal of the sixth TFT 622, and performs a switching operation for passing or blocking a panel threshold voltage in accordance with control of the first switch control signal AZ.

Figure 7:
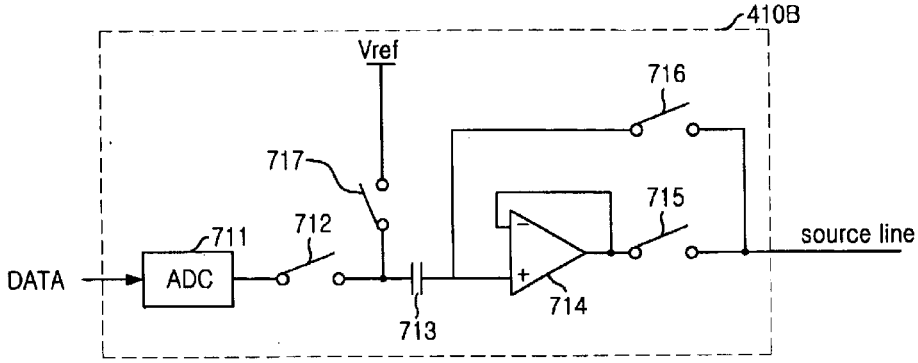
FIG. 7 is a circuit diagram showing a flat display panel device for compensating a threshold voltage of a panel in accordance with another preferred embodiment of the present invention.

FIG. 7 is a circuit diagram showing a driving unit 410B included in a flat display panel device for compensating a threshold voltage of a panel in accordance with another preferred embodiment of the present invention. The driving unit 410B includes a second analog-to-digital converter (hereinafter referred as to ADC) 711, a sixth switch 712, a sixth capacitor 713, a second amplifier 714, a seventh switch 715, an eighth switch 716 and a ninth switch 717.

The second ADC 711 converts analog data inputted from an outer source into digital data, which is, in turn, outputted to the sixth switch 712.

Also, the sixth switch 712 having a first terminal connected to the second ADC 711 performs a switching operation for passing or blocking the digital data outputted from the second ADC 711.

Meanwhile, the sixth capacitor 713 included in the driving unit 410B having a first terminal connected to a second terminal of the sixth switch 712 stores charges as being supplied with a voltage corresponding to the digital data from the sixth switch 712.

Also, the second amplifier 714 included in the driving unit 410B has a positive terminal connected to a second terminal of the sixth capacitor 713 and a negative terminal connected to a feedback of an output terminal amplifies an inputted voltage.

In the mean time, the seventh switch 715 included in the driving unit 410B has a first terminal connected to the output terminal of the second amplifier 714 and a second terminal connected to a source line. The seventh switch 715 passes or blocks the amplified voltage outputted from the second amplifier 714 to the display unit 420A.

Also, the eighth switch 716 included in the driving unit 410B having a first terminal connected to the source line and a second terminal connected to the positive terminal of the second amplifier 714 performs a switching operation for passing or blocking a panel threshold voltage sampled from the display unit 420A.

The ninth switch 717 included in the driving unit 410B having a first terminal connected to a reference voltage $V_{ref}$ and a second terminal connected to the first terminal of the sixth capacitor 713 performs also a switching operation for passing or blocking the $V_{ref}$. Herein, the $V_{ref}$ can be used as a reference voltage for storing the panel threshold voltage in an appropriate level and can be also used by supplying a compensation voltage for a threshold value of the panel luminescent device 424 or precharge since the panel luminescent device 424 has a characteristic of a diode.

Figure 8:
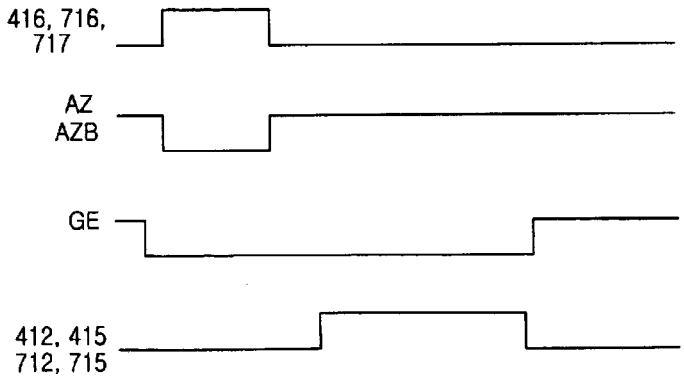
FIG. 8 is a timing diagram showing operation of a flat panel display device for compensating a threshold voltage of a panel in accordance with further preferred embodiment of the present invention.

FIG. 8 is a timing diagram showing operation of the flat display panel device for compensating a threshold voltage of a panel in accordance with preferred embodiments of the present invention. It is seen from FIG. 8 that providing the second switch control signal AZB can also control operations of the overall panel simultaneously.

In accordance with the present invention, the panel of the flat display panel device is constructed more simply so to increase an opening ratio of an organic electroluminescence (OEL) device. As a result of this increase, it is possible to prevent an increase in unnecessary currents for increasing levels of brightness and contrast and to compensate characteristics of the diode of the panel luminescent device.

While the present invention has been described with respect to certain preferred embodiments, it will be apparent to those skilled in the art that various changes and modifications may be made without departing from the scope of the invention as defined in the following claims.

What is claimed is:

1. A flat display panel device for compensating a panel threshold voltage, comprising:

a driving unit receiving a panel threshold voltage and outputting a driving signal, wherein the driving unit samples and charges the panel threshold voltage supplied from a source line and generates the driving signal from the panel threshold voltage charged therein when a displaying data is inputted thereto; and a displaying unit, wherein the displaying unit displays by driving a luminescent device therein with a gate enable signal from a gate enable line, a power from a power line and the driving signal from the driving unit, and supplies the panel threshold voltage to the driving unit by receiving a first switch control signal wherein the driving unit further includes:

a first analog-to-digital converter (ADC) for converting externally inputted analog data into digital data;

a first switch having a first terminal connected to the first ADC and performing a switching operation for passing or blocking the digital data outputted from the first ADC;

a first capacitor having a first terminal connected to a second terminal of the first switch and charging a voltage corresponding to the digital data from the first switch;

a first amplifier having a positive terminal connected to a second terminal of the first capacitor and a negative terminal connected to an output terminal in feedback;

a second switch having a first terminal connected to the output terminal of the first amplifier and a second terminal connected to the source line and performing a switching operation for passing or blocking a voltage outputted from the first amplifier to the display unit;

a third switch having a first terminal connected to the source line and performing a switching operation for passing or blocking the panel threshold voltage sampled from the display unit; and a second capacitor having a first terminal connected to the third switch and a second terminal being supplied with a reference voltage and charging the panel threshold voltage after being supplied with the panel threshold voltage from the third switch.

2. The flat display panel device as recited in claim 1, wherein the reference voltage is a reference voltage for storing the panel threshold voltage.

3. The flat display panel device as recited in claim 1, wherein the reference voltage is a compensation voltage for the panel threshold voltage or pre-charge of the luminescent device.

4. The flat display panel device as recited in claim 1, wherein the display unit further comprises:

a fourth switch having a first terminal that receives the driving signal from the source line and also receives the gate enable signal from the gate enable line and performing a switching operation for passing or blocking the driving signal in accordance with control of the gate enable signal;

a first thin film transistor (TFT) having a first terminal being supplied with power from the power line and a second terminal connected to a second terminal of the fourth switch;

a third capacitor having a first terminal connected to the first terminal of the first TFT and a second terminal connected to the second terminal, of the fourth switch for charging a driving voltage of the first TFT;

a panel luminescent device having a first terminal connected to the second terminal of the first TFT and a second terminal connected to a ground terminal for luminescing when currents flow; and a fifth switch having a first terminal connected to a third terminal of the first TFT, a second terminal that receives the first switch control signal from the control signal input line and a third terminal connected to the second terminal of the first TFT and performing a switching operation for passing or blocking the threshold voltage in accordance with control of the first switch control signal.

5. The flat display panel device as recited in claim 1, wherein the display unit further comprises:

a second TFT having a first terminal receiving the driving signal from the source line and a second terminal receiving the gate enable signal from the gate enable line;

a third TFT having a first terminal being supplied with power from the power line and a second terminal connected to the second terminal of the second TFT;

a fourth capacitor having a first terminal connected to the first terminal of the third TFT and a second terminal connected to a third terminal of the second TFT and charging a driving voltage of the third TFT;

a panel luminescent device having a first terminal connected to a third terminal of the third TFT and a second terminal coupled to a ground terminal and luminescing when current flow; and a fourth TFT having a first terminal connected to the third terminal of the third TFT, a second terminal receiving the first switch control signal from the control signal input line and a third terminal connected to the second terminal of the third TFT.

6. The flat display panel device as recited in claim 1, wherein the display unit further comprises:

a fifth TFT having a first terminal that receives the driving signal from the source line and a second terminal that receives the gate enable signal from the gate enable line and performing a switching operation for passing or blocking the driving signal in accordance with control of the gate enable signal;

a sixth TFT having a first terminal being supplied with power from the power line and a second terminal connected to the second terminal of the fifth TFT;

a fifth capacitor having a first terminal connected to the first terminal of the sixth TFT and a second terminal connected to a third terminal of the fifth TFT and charging a driving voltage of the sixth TFT;

a seventh TFT having a first terminal connected to a third terminal of the sixth TFT and a second terminal that receives a second switch control signal and performing a switching operation for passing or blocking the driving voltage in accordance with control of the second switch control signal;

a panel luminescent device having a first terminal connected to a third terminal of the seventh TFT and a second terminal coupled to a ground terminal and luminescing when currents are flowing; and an eighth TFT having a first terminal connected to the third terminal of the sixth TFT, a second terminal that receives the first switch control signal form the control signal input line and a third terminal connected to the second terminal of the sixth TFT.

7. The flat display panel device as recited in claim 1, wherein the driving unit further comprises:

a second ADC for converting externally inputted analog data into digital data;

a sixth switch having a first terminal connected to the second ADC and performing a switching operation for passing or blocking the digital data outputted from the second ADC;

a sixth capacitor having a first terminal connected to a second terminal of the sixth switch and charging a voltage corresponding to the digital data after being supplied from the sixth switch;

a second amplifier having a positive terminal connected to a second terminal of the sixth capacitor and a negative terminal connected to an output terminal in feedback and amplifying an input voltage;

a seventh switch having a first terminal connected to the output terminal of the second amplifier and a second terminal connected to the source line and performing a switching operation for passing or blocking the amplified voltage outputted from the second amplifier to the display unit;

an eighth switch having a first terminal connected to the source line and a second terminal connected to the positive terminal of the second amplifier and performing a switching operation for passing or blocking a threshold voltage sampled from the display unit; and a ninth switch having a first terminal connected to the reference voltage and a second terminal connected to the first terminal of the sixth capacitor and performing a switching operation for passing or blocking the reference voltage.

* * * * *